US008486327B2

(12) United States Patent
Stilkerieg

(10) Patent No.: US 8,486,327 B2
(45) Date of Patent: Jul. 16, 2013

(54) SEALING PLUG FOR TILTABLE CONVERTERS

(76) Inventor: Berthold Stilkerieg, Niederzissen (DE)

( * ) Notice: Subject to any disclaimer, the term of this patent is extended or adjusted under 35 U.S.C. 154(b) by 254 days.

(21) Appl. No.: 13/059,698

(22) PCT Filed: Aug. 14, 2009

(86) PCT No.: PCT/DE2009/001160

§ 371 (c)(1),
(2), (4) Date: Mar. 3, 2011

(87) PCT Pub. No.: WO2010/020229

PCT Pub. Date: Feb. 25, 2010

(65) Prior Publication Data

US 2011/0148013 A1 Jun. 23, 2011

(30) Foreign Application Priority Data

Aug. 21, 2008 (DE) ..... 10 2008 039 142

(51) Int. Cl.
*C21C 5/48* (2006.01)
*C21B 7/12* (2006.01)

(52) U.S. Cl.
USPC ..... 266/272; 266/236

(58) Field of Classification Search
USPC ..... 266/272, 271, 236, 45
See application file for complete search history.

(56) References Cited

U.S. PATENT DOCUMENTS 4,143,867 A * 3/1979 Hoppe et al. ..... 266/272
6,241,941 B1 * 6/2001 Stilkerieg ..... 266/272

FOREIGN PATENT DOCUMENTS

DE 19848004 4/2000

* cited by examiner

*Primary Examiner* — Scott Kastler
(74) *Attorney, Agent, or Firm* — James Creighton Wray

(57) ABSTRACT

A sealing plug 1, consisting of fireproof material 10 located between the upper shaping plate 19 and the lower shaping plate 20, is used to seal the tap hole 3 of a tiltable converter 2. Said fireproof material 10 consists of bonding clay, water, oil and other constituents, particularly of 10-30% by weight hollow glass balls made of "foam glass" produced from recovered glass which have a rough surface suitable for binding large volumes of moisture. The sealing plug 1 thus retains the necessary stability even over longer periods and can thus be shaped in the tap hole 3 so that it is arrested against the wall 28, even after longer periods of storage. The hollow glass balls 11, 12, 13, 14 also entail a significant reduction in the weight of the entire sealing plug 1.

14 Claims, 3 Drawing Sheets

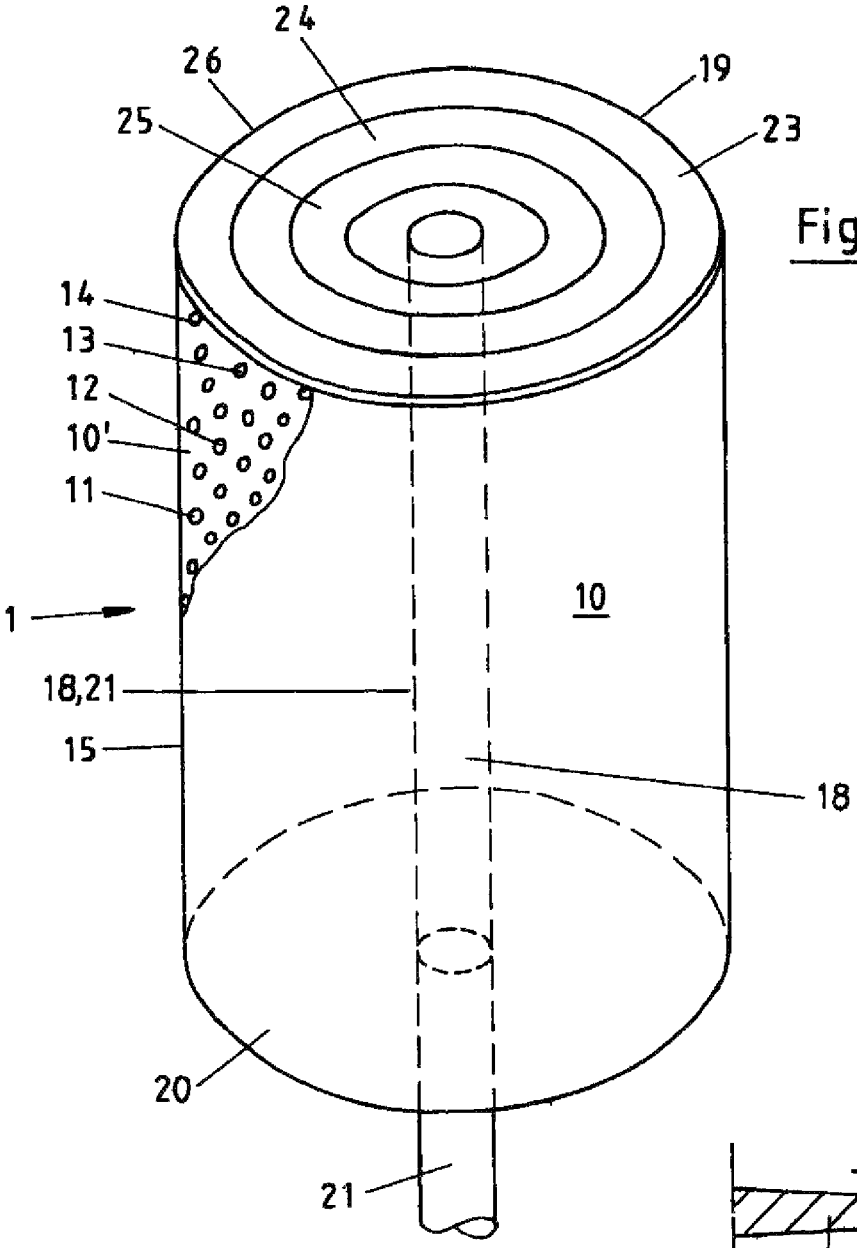
Fig.3
Fig.3a
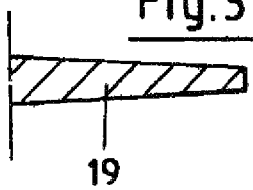
Fig.3b
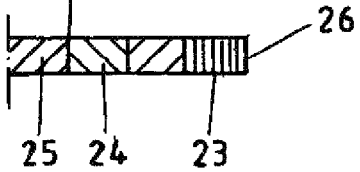
Fig.3c
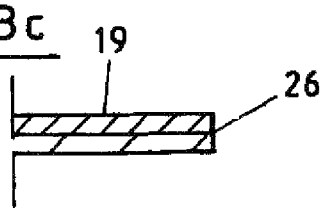

SEALING PLUG FOR TILTABLE CONVERTERS

This application claims the benefit of German Application No. 10 2008 039 142.5 filed Aug. 21, 2008 and PCT/DE2009/001160 filed Aug. 14, 2009, which are hereby incorporated by reference in their entirety as if fully set forth herein.

The invention concerns a sealing plug for the tap hole of a tiltable converter which can be introduced into the tap hole from the outside to the inside and secured there so that it is washed out of the tap hole by and with the molten steel, and which consists of fireproof material with constituents of clay, binders, water and mineral oil. The invention also concerns a method of making a sealing plug consisting of a clay constituent, binder, water, mineral oil and fireproof material containing additives, to be used for the temporary closure of the tapping hole of a tiltable converter.

Tiltable converters have an outlet or tap hole piercing the wall of the converter, to transfer the molten steel to the tapping ladle or ladle car. For emptying, the converter is tilted, so that the steel can flow out through the tap hole. As specifically lighter slag of different viscosities always floats on the molten steel, it has to enter the tap hole first during tilting and thus the ladle or ladle car, to a greater or lesser extent. The presence of oxygen-rich and frequently phosphorous- or sulphur-enriched slag represents a considerable disadvantage to numerous subsequent metallurgical processes. A sealing plug has therefore been successfully developed (EP 0 635 071) which consists of a plastic material which can be introduced into the tap hole and then worked between two shaping plates so that it remains in the tap hole automatically. The upper shaping plate takes the form of a funnel with a transition to a tube which extends to the lower shaping plate, which serves as an abutment for a shaping device. The shaping device has a claw which is passed through the tube and which can be drawn in the direction of the lower shaping plate with the necessary force, in order to shape the plastic area of the plug appropriately between the two shaping plates. The plastically-formed fireproof material consists mainly of bonding clay, alum silicate, water, plasticisers, binders and additives. In accordance with DE 198 48 004 A1, a not inconsiderable volume of hydrocarbon compounds in the form of polystyrene foam balls are mixed with the fire resistant material as an additive, firstly to reduce the weight of the sealing plug and secondly to achieve better and more even shaping of the sealing plug. However, a disadvantage is that polystyrene foam, which does not absorb any water, tends to have a destabilising effect, so that, in particular, the shelf life of such a sealing plug is limited. Another disadvantage is that fireproof material does not have a consistent plastic effect due to the polystyrene foam, which has a negative effect on the process.

The invention is therefore based on the task of creating a lightweight sealing plug with a long shelf life.

The task is solved inventively by the fireproof material being mixed with hollow mineral glass balls, which are formed so that they absorb a limited amount of water.

By a corresponding addition to the fireproof material and dispensing with the slightly destabilising polystyrene grains or balls, an advantageously elastic material which remains practically stable in the long term is obtained by adding suitable hollow mineral glass balls to the mixture. As the hollow glass balls have a suitable surface area, absorb and specifically retain water, the water content of the finished sealing plug develops very positively. The shelf life is increased by about 100%, making storage for several months possible without problems.

A practical embodiment of the invention provides for the mineral glass balls having a diameter of 0.2-5 mm, preferably 0.5-1 mm. Such glass balls are advantageously stable, can be mixed well and are outstandingly compatible with the clay constituents, which they supply specifically with water during storage so that the clay constituents retain their flexibility. As demanded by the problem, the mineral glass balls entail a considerable reduction in weight, even with the relatively small diameters required. If a proportion of the polystyrene foam balls are replaced by hollow glass balls, the total weight of the sealing plug falls by much more than 20%.

A reduction in weight of almost exactly 20% is achieved if the proportion of the mineral glass balls is 5-40% by weight, preferably 10-30% of the total fireproof material. Particularly at 10-30%, the sealing plug has the necessary stability and the longer storage potential, so that it is considerably easier to handle, store and use at its reduced weight.

It was stated above that the hollow glass balls absorbing a limited amount of water have a special external surface, this particularly being the case if the mineral glass balls are foam glass balls. Production of this foam glass does not give it a smooth surface, but rather the desired rough surface, on which droplets of water can be deposited advantageously.

It is particularly advantageous for the hollow mineral glass balls to consist of foam glass made of recovered glass, because the foam glass not only thus adopts the desired form, but also because the price can be kept down, which proves an advantage when selling the sealing plug.

The tap hole receives a different shape, not least from the flow of the molten and therefore hot steel. It has proved particularly practical to work the plug consisting of the fireproof material with the hollow mineral glass balls into a cylinder, which can then be pressed against the walls of the tap hole after it has been introduced into said tap hole. The cylindrical shape is optimally suited to any shape of tap hole, even if the shape of the latter is changed somewhat in the course of its useful life.

Where the tap hole is shaped like a funnel, whether in the direction of inlet or outlet, it is advantageous for the plug to have the shape of a truncated cone. It can then be introduced into the funnel-shaped tap hole in the appropriate direction and secured there by pressure.

In known sealing plugs, the upper shaping plate has a funnel shape from the outset, i.e. it forms a suitable transition to the tube. A further embodiment of the invention provides for the plug having an internal bore and an upper and a lower shaping plate, whereby the thickness of the upper shaping plate, formed as a transition to the internal bore, increases in the direction of the internal bore. This particular shape of the upper shaping plate means that, although the entire plug or the upper side initially moves against the lower shaping plate, the central part of the upper plate advances as pressure increases, so that the practical funnel emerges. It is advantageous for the plug itself not to be placed under pressure until the upper shaping plate moves, not when a correspondingly self-formed shaping plate is placed upon it.

A further embodiment of the invention provides for the upper shaping plate to be composed of several metal rings of differing elasticity or stability, the elasticity of the metal rings decreasing in the direction of the outer rim. Such an embodiment also achieves the formation of a funnel in the middle, intended to encourage the escape of the molten steel. In this case, the upper shaping plate consisting of metal rings is deformed in advance in the vicinity of the tube, whilst the outer rim remains more stable or is ultimately not deformed at all, thus ensuring that the entire plug is shaped appropriately, moves against the wall of the bore and is secured there.

Corresponding shaping or compression of the plug is particularly well achieved if the upper shaping plate and a tube introduced into the internal bore form one unit, whereby the lower shaping plate is embodied to serve as an abutment. In such an embodiment there is a possibility of practically pulling on the tube in order to move the upper shaping plate in the direction of the lower shaping plate, shaping the corpus of fireproof material between them. Whether this is more practical or whether it is more practical to work with a claw which can be pushed through the tube, as hitherto, may remain unresolved, but the desired arrest of the plug in the tap hole may also be achieved in this way. This embodiment also provides the possibility either of forming the upper shaping plate as a funnel, as hitherto, or of working with the metal rings or with shaping plates of different thicknesses. The upper shaping plate terminates at the edge if possible, in order to leave little space for the slag at the internal edge. The lower shaping plate should therefore be moveable if possible.

In the preceding claims for the device, a plug with increased stability and low intrinsic weight is protected. In such a plug, the fireproof material to be arranged between the upper and lower shaping plate is a mixture of 10-30% by weight of mineral foam glass balls;
20-40% by weight of selected bonding clay;
20-40% by weight of alum silicate;
1-20% by weight of water;
5-20% by weight of mineral oil;
0.5-3% by weight of plasticisers;
0.1-2% by weight of liquefier;
0.1-2% by weight of temporary binder;
0.1-5% by weight of permanent binder.

It has emerged that a fireproof material mixed in such a way fulfils the desired requirements precisely, namely reduced intrinsic weight, good, consistent deformability and long shelf life. The hollow foam glass balls used can absorb a large volume of moisture, i.e. water, but possibly other liquids as well, in order to provide the necessary flexibility within the fireproof material or the plug made from it for long periods. The mixture described may be varied within the limits specified, depending on which of the targets is the more important.

In manufacturing such a sealing plug, which is intended for the temporary closure of the tap hole of a tiltable converter, the individual constituents, i.e. the clay constituents, binders, water and mineral oil, and the various additives, must be mixed together evenly to form a fireproof material. The invention provides for the use of hollow mineral glass balls as additives, which are soaked before mixing with the other constituents of the mixture, binding 100% of their intrinsic weight in water to themselves. Reference has already been made to these hollow glass balls being a particular type of hollow glass ball, namely mineral with a special surface, which are suitable for binding water or other liquids to themselves. The use of foam glass balls made from recovered glass has proved particularly practical. These foam glass balls have a rough surface area, which is suitable for binding corresponding volumes of moisture, i.e. particularly water, and also retaining it following mixing with the remaining constituents until said other constituents require the moisture and can absorb it from the foam glass balls. Particularly the bonding clay and the alum silicate remain so elastic or plastic that they can still be mixed perfectly even after long storage periods.

A sealing plug with a particularly favourable shelf life can be produced by this method by forming the mixture after mixing, applying the deforming plates and tube at the same time or afterwards and then sealing it hermetically all round in film. This means that initially all the fireproof material, including the hollow mineral glass balls consisting of foam glass is made, then shaped appropriately, for example as a cylinder or truncated cone, then given the tube and shaping plates and sealed all round in film. A sealing plug made in this way is ready for despatch and may be stored safely by the manufacturer or user for longer periods, i.e. at least up to six months, then used in the converter. It is also perfectly workable even after such long storage, whereby it is also theoretically possible to despatch the plug itself without the upper shaping plate and tube and only apply these parts shortly before use, independently of which the plug itself or the body of the plug remains perfectly workable. It has optimum strength, a significantly lower intrinsic weight, can thus also be handled better and can be introduced precisely into the end of the tap hole and secured there because of its ease of handling, so that the proportion of any slag which may solidify can be reduced to a minimum.

The invention is particularly distinguished by the creation of a sealing plug and a method of producing said plug which provide a sealing plug for use in tiltable converters which is optimally workable because it retains the necessary plasticity over long periods, retains the necessary moisture and thus workability throughout its dimensions and is significantly more workable due to its low weight than the sealing plug enriched with polystyrene foam known from prior art. The particular attributes and characteristics of the inventive sealing plug are particularly advantageous because they provide the possibility of despatching the sealing plug even over great distances and thus corresponding periods all over the world. They not only retain their shape optimally during carriage because of their characteristic stability, but also during storage by the user. They are then available to the user in precisely the specified form and still have the necessary workability, so that they can always be located securely and consistently in the respective tap hole.

Further details and advantages of the inventive item emerge from the following description of the relevant drawing, which shows a preferred specimen embodiment with the necessary details.

BRIEF DESCRIPTION OF THE DRAWINGS

FIG. 3 is an enlarged reproduction of a sealing plug;

FIGS. 3*a*-3*c* are sections through different embodiments of upper shaping plates;

DETAILED DESCRIPTION OF THE PREFERRED EMBODIMENTS

Figure 1:
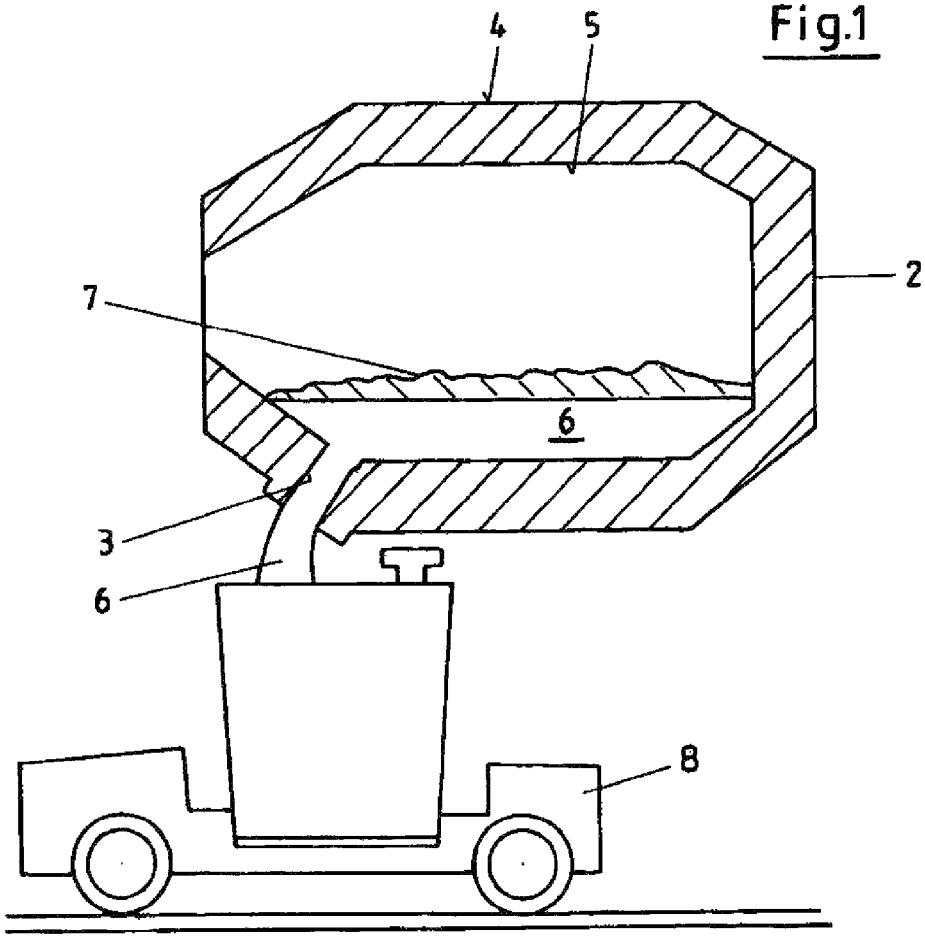
FIG. 1 shows a converter during the drainage of the liquid steel through the tap hole provided in the converter.

FIG. 1 shows a converter 2 in its tilted position, whereby it is clear that the molten steel 6 can flow out of the tap hole 3 in a stream. A thick layer of slag 7 lies on the molten steel 6 in the converter 2 and cannot flow out with it in this position.

The tap hole 3 extends from the external wall 4 to the inside of the converter 5 and is at least cylindrical in shape here. The molten steel 6 flows into a ladle car 8 and can then be moved to the next stage in the process. The sealing plug 1 not shown here has long been washed out in this position of the converter 2 and is located in the ladle car 8, whereby the volume is so small that it is immaterial.

Figure 2:
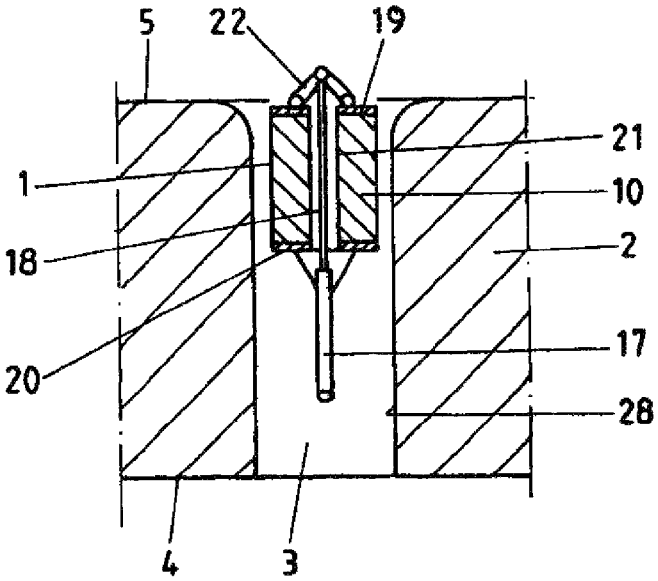
FIG. 2 is a section through the vicinity of the tap hole inside the converter, with the sealing plug introduced, but not yet shaped.

FIG. 2 is a section through the wall of the converter 2, whereby a sealing plug 1 is inserted in the tap hole 3. This sealing plug 1 consists of fireproof material 10 enriched with hollow glass balls, as will be elucidated below. It takes the form of a cylinder 15 and is pierced by a tube 21 introduced into the internal bore 18, so that a jig 17 with the upper claw 22 can be pushed through it, to affect the upper shaping plate 19 in the direction of the lower shaping plate 20 and make it press against the wall 28 of the tap hole 3 in the position shown. After the plug has been shaped, the claw 22 can be removed through the tube 21 by deactivating the corresponding elements, so that the sealing plug closes the tap hole 3 until it is washed out by the molten steel 6.

FIG. 3 shows a sealing plug 1, consisting of a fireproof material 10. 10-30% by weight hollow glass balls 11, 12, 13, 14 made of foam glass produced from recovered glass, are mixed into this fireproof material 10 and have a rough surface, in which moisture, i.e. predominantly water, can be deposited. Here too, the plug 1 takes the form of a cylinder 15. The internal bore 18 is discernable, in which the tube 21 is inserted, thus connecting the upper shaping plate 19 with the lower shaping plate 20. There is an indication that the upper shaping plate 19 is composed of different metal rings 23, 24, 25, the flexibility of which decreases towards the outer rim 26, so that the inner metal ring 25 begins to deform first and the outer metal ring 23 begins to deform last when the tube 21 is pulled. This forms a funnel, which is of subsequent advantage to drainage of the molten steel 6.

FIGS. 3*a*, 3*b* and 3*c* show different embodiments of materials for the upper shaping plate 19. whereby, in FIG. 3*a*, the thickness decreases from the inside to the outside, so that a funnel shape emerges when the upper shaping plate 19 is affected. The same is achieved with an embodiment in accordance with FIG. 3*b*, with the metal rings 23, 24 and 25 of different flexibility. In FIG. 3*c*, different materials are combined into a corresponding upper shaping plate 19, which also make it possible for shaping plate 19 to deform first in the middle and only then in the vicinity of the outer rim 26, or vice versa.

Figure 4:
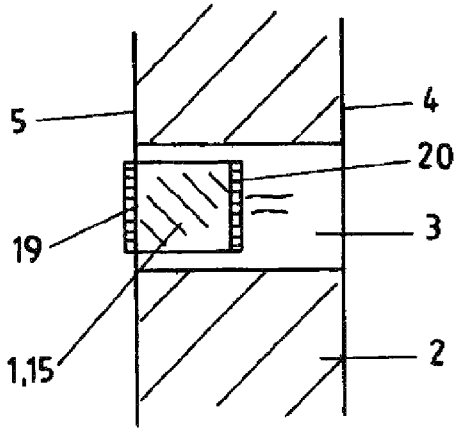
FIG. 4 is a section through a tap hole with a cylindrical cross section and a cylindrical sealing plug.
Figure 5:
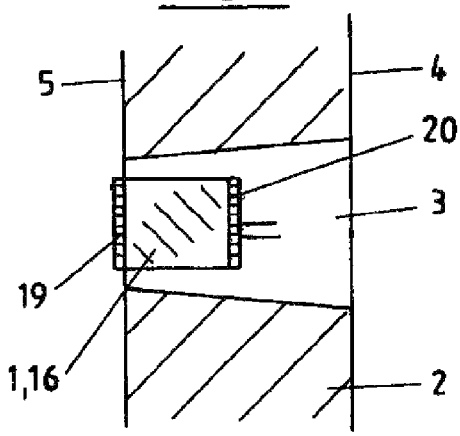
FIG. 5 shows a tap hole in the shape of a of funnel narrowing inwards with a cone-shaped plug.
Figure 6:
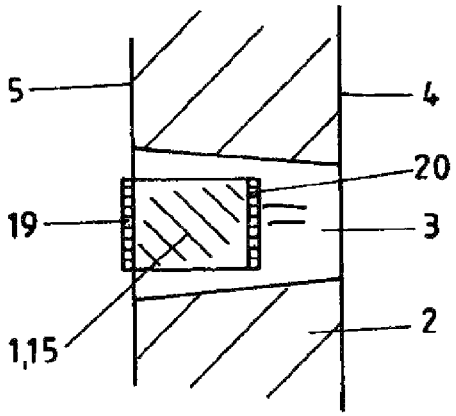
FIG. 6 shows a section through a tap hole with the shape of a funnel narrowing outwards with a cylindrical plug inserted.
Figure 7:
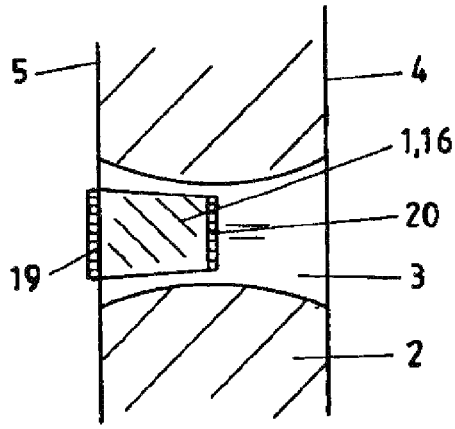
FIG. 7 shows a tap hole with an X-shaped cross section and a tapered plug.

FIGS. 4 to 7 show that it is possible to adapt the inventive sealing plug 1 to the shape of the tap hole 3. In FIG. 4, the tap hole 3 has the same shape throughout and thus reproduces the shape of a cylinder. A sealing plug 1 with the shape of a cylinder 15 is introduced into this suitably-formed tap hole 3. In FIGS. 5 and 7, the sealing plug 1 has the shape of a truncated cone 16, 16', so that it can be secured optimally against the wall 28 of the tap hole 3. The same also applies to FIG. 6, where the cylindrical shape is advantageous, in order to be able to push the sealing plug 1 securely in tap hole 3.

Figure 8:
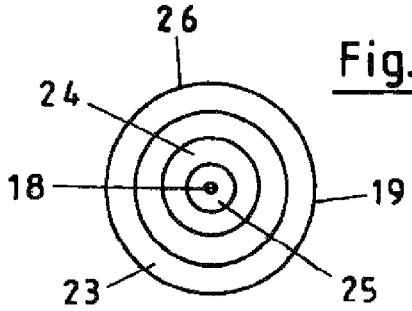
FIG. 8 is a horizontal projection of the upper shaping plate, composed of a plurality of rings.

Finally, FIG. 8 shows an upper shaping plate 19, which is composed of metal rings 23, 24, 25 in different forms and thus ensures that even shaping of the sealing plug 1 is possible from the outer rim 26, even if, as desired, the funnel through which the molten steel 6 can flow out favourably in the subsequent process is specified as central.

All the characteristics specified, including those which can only be taken from the drawings, are regarded as germane to the invention, in isolation and in combination.

The invention claimed is:

1. A sealing plug for the tap hole (3) of a tiltable converter (2) which can be introduced into the tap hole (3) from the outside of the converter (2) to the inside (5) of the converter and secured there so that it is washed out of the tap hole (3) by and with molten steel (6), and which comprises fireproof material (10) with constituents of clay, binders, water and mineral oil, wherein the fireproof material (10) is mixed with hollow mineral glass balls (11, 12, 13, 14), which are formed to absorb water.

2. The sealing plug in accordance with claim 1, wherein the hollow mineral glass balls (11, 12, 13, 14) have a diameter of 0.2-5 mm.

3. The sealing plug in accordance with claim 1, wherein that the volumetric proportion represented by the hollow mineral glass balls (11, 12, 13, 14) is 5-40% of the entire fireproof material (10).

4. The sealing plug in accordance with claim 1, wherein the hollow glass mineral balls (11, 12, 13, 14) are foam glass balls.

5. The sealing plug in accordance with claim 1, wherein the hollow mineral glass balls (11, 12, 13, 14) consist of foam glass made of recovered glass.

6. The sealing plug in accordance with claim 1, wherein the plug (1) consisting of the fireproof material (10) with the hollow mineral glass balls (11, 12, 13, 14) is shaped into a cylinder (15).

7. The sealing plug in accordance with claim 1, wherein the plug (1) has the shape of a truncated cone (16).

8. The sealing plug in accordance with claim 1, wherein the plug (1) has an internal bore (18) and an upper and a lower shaping plate (19, 20), whereby the thickness of the upper shaping plate (19), formed as a transition to the internal bore (18), increases in the direction of the internal bore (18).

9. The sealing plug in accordance with claim 1, wherein an upper shaping plate (19) is composed of several metal rings (23, 24, 25) of differing elasticity or stability, the elasticity of the metal rings (23, 24, 25) decreasing in the direction of the outer rim (26).

10. The sealing plug in accordance with claim 1, wherein an upper shaping plate (19) and a tube (21) introduced into an internal bore (18) form one unit, whereby a lower shaping plate (20) is embodied to serve as an abutment.

11. The sealing plug in accordance with claim 1, wherein the plug (1) or fireproof material (10) is mixed from 10-30% by weight of hollow mineral foam glass balls; 20-40% by weight of selected bonding clay; 20-40% by weight of alum silicate; 1-20% by weight of water; 5-20% by weight of mineral oil; 0.5-3% by weight of plasticisers; 0.1-2% by weight of liquefier; 0.1-2% by weight of temporary binder; 0.1-5% by weight of permanent binder.

12. A method of making a sealing plug mixture consisting of a clay constituent, binder, water, mineral oil and fireproof material containing additives, to be used for the temporary closure of the tapping hole of a tiltable converter wherein hollow mineral glass balls, which are soaked before mixing with the other constituents of the mixture, binding 100% of their intrinsic weight in water to themselves, are used as additives.

13. The method in accordance with claim 12, wherein foam glass balls made from recovered glass are used as hollow mineral glass balls.

14. The method in accordance with claim 12, wherein the mixture is shaped after mixing, applying the shaping plates and tube at the same time or afterwards, and then sealed hermetically all round in film.

* * * * *